US008587575B2

(12) United States Patent
Ahn

(10) Patent No.: US 8,587,575 B2
(45) Date of Patent: Nov. 19, 2013

(54) DISPLAY DEVICE CONTROLLING A POWER SOURCE TO EQUAL A SATURATION VOLTAGE AND DRIVING METHOD THEREOF

(75) Inventor: Jung-Keun Ahn, Yongin (KR)

(73) Assignee: Samsung Display Co., Ltd., Yongin, Gyunggi-Do (KR)

( * ) Notice: Subject to any disclaimer, the term of this patent is extended or adjusted under 35 U.S.C. 154(b) by 744 days.

(21) Appl. No.: 12/801,202

(22) Filed: May 27, 2010

(65) Prior Publication Data

US 2011/0050669 A1 Mar. 3, 2011

(30) Foreign Application Priority Data

Sep. 3, 2009 (KR) ..... 10-2009-0083127

(51) Int. Cl.
*G09G 5/00* (2006.01)

(52) U.S. Cl.
USPC ..... 345/211

(58) Field of Classification Search
USPC ..... 345/211–213; 315/169.1–169.4
See application file for complete search history.

(56) References Cited

U.S. PATENT DOCUMENTS

| | | | | |
|---|---|---|---|---|
| 7,479,955 | B2 * | 1/2009 | Yoshida | 345/211 |
| 2006/0158128 | A1 * | 7/2006 | Hu | 315/169.3 |
| 2009/0201281 | A1 * | 8/2009 | Routley et al. | 345/212 |

FOREIGN PATENT DOCUMENTS

KR 10 2008-0045192 A 5/2008

* cited by examiner

*Primary Examiner* — Chanh Nguyen
*Assistant Examiner* — Ram Mistry
(74) *Attorney, Agent, or Firm* — Lee & Morse, P.C.

(57) ABSTRACT

A driving method of a display device that includes a display panel including a plurality of light emitting elements, is supplied with a power source voltage, and includes a saturation region and a non-saturation region according to variation of a panel current flowing to the display panel is provided. The driving method includes sensing the panel current, determining the power source voltage and the panel current, controlling a feedback voltage to drive the power source voltage to be equal to a saturation voltage corresponding to a saturation point at a boundary between the saturation region and the non-saturation region based on the determined power source voltage and the determined panel current, and controlling the power source voltage according to the feedback voltage to supply the controlled power source voltage to each of the plurality of light emitting elements.

16 Claims, 13 Drawing Sheets

FIG.6

$$\Delta(A - B1) < \Delta(A - Bn)$$
$$\Delta(A - B2) < \Delta(A - Bn-1)$$
$$\Delta(A - B3) < \Delta(A - Bn-2)$$
$$\vdots$$
$$\Delta(A - Bx) > \Delta(A - Bn-x-1)$$

FIG.9

$$\Delta(A - B1) - \Delta(A - B2) > \alpha$$
$$\Delta(A - B2) - \Delta(A - B3) > \alpha$$
$$\Delta(A - B3) - \Delta(A - B2) > \alpha$$
$$\vdots$$
$$\Delta(A - Bx) - \Delta(A - Bx+1) < \alpha$$

FIG.11

$$\Delta(D1 - D2) - \Delta(D2 - D3) > \alpha$$
$$\Delta(D3 - D4) - \Delta(D4 - D5) > \alpha$$
$$\Delta(D5 - D6) - \Delta(D6 - D7) > \alpha$$
$$\vdots$$
$$\Delta(Dx-1 - Dx) - \Delta(D1 - Dx+1) < \alpha$$

FIG.13

$$\Delta(E2 - E1) < \Delta(E3 - E2)$$
$$\Delta(E3 - E2) < \Delta(E4 - E3)$$
$$\Delta(E4 - E3) < \Delta(E5 - E4)$$
$$\vdots$$
$$\Delta(Ex - Ex-1) > \Delta(Ex+1 - Ex)$$

DISPLAY DEVICE CONTROLLING A POWER SOURCE TO EQUAL A SATURATION VOLTAGE AND DRIVING METHOD THEREOF

BACKGROUND

1. Field

Embodiments relate to a display device and a driving method thereof. More particularly, embodiments relate to an organic light emitting diode (OLED) display and a driving method thereof.

2. Description of the Related Art

A display device includes a plurality of pixels arranged on a substrate in the form of a matrix, defining a display area. Scan and data lines are connected to the respective pixels. Data signals are selectively applied to the pixels to display desired images. Display devices can be classified as passive and active matrix types, depending upon the method of driving the pixels. In view of resolution, contrast, and response time, the trend is towards the active matrix type where the respective unit pixels are selectively turned on or off.

Display devices may be used as display units for personal computers, portable phones, personal digital assistants (PDAs), other mobile information devices, or as a monitor for various kinds of information systems. A liquid crystal panel-based LCD, an organic electroluminescent display using an organic light emitting element, a plasma panel-based PDP, etc., are well known. Various kinds of emissive display devices, which are lighter in weight and smaller in volume than CRTs, have been recently developed. Organic light emitting diode displays are receiving much attention as a result of their emissive efficiency, luminance, viewing angle, and fast response time.

Organic electroluminescent displays may be driven using a passive matrix method or an active matrix method. With the passive matrix method, the organic light emitting elements are formed between anode lines and cathode lines that perpendicularly cross each other, and are driven by selecting the respective lines. With the active matrix method, a thin film transistor (TFT) and a capacitor are integrated into each pixel, and the organic light emitting elements are driven according to a voltage maintained by capacitance of the capacitor. With the active matrix method, a constant current can flow to the organic light emitting element when the thin film transistor operates in a saturation region. A source-drain voltage of the thin film transistor is determined by a driving voltage applied to an organic light emitting diode (OLED). However, the driving voltage applied to the OLED is changed in accordance with deterioration and temperature of the OLED. Therefore, a predetermined margin is set when the driving voltage is applied in an attempt to operate the thin film transistor with a constant current source even though the driving voltage of the OLED changes. The margin causes unnecessary power consumption.

The above information disclosed in this Background section is only for enhancement of understanding of the background of the invention and therefore it may contain information that does not form the prior art that is already known in this country to a person of ordinary skill in the art.

SUMMARY

Embodiments are therefore directed to a display device and a driving method thereof, which substantially overcome one or more of the problems due to the limitations and disadvantages of the related art.

It is therefore a feature of an embodiment to provide a display device adapted for operation with relatively less power than comparable conventional devices.

It is therefore a separate feature of an embodiment to provide a driving method of a display device adapted for operation with relatively less power than comparable driving methods.

At least one of the above and other features and advantages may be realized by providing a driving method for a display device including a display panel that is supplied with a power source voltage, and includes a plurality of light emitting elements, and a saturation region and a non-saturation region according to variation of a panel current flowing to the display panel, the driving method including sensing the panel current, determining the power source voltage and the panel current, controlling a feedback voltage to drive the power source voltage to be equal to a saturation voltage corresponding to a saturation point at a boundary between the saturation region and the non-saturation region based on the determined power source voltage and the determined panel current, and controlling the power source voltage according to the feedback voltage to supply the controlled power source voltage to each of the plurality of light emitting elements.

Controlling the feedback voltage may include varying the power source voltage to be different levels, storing the power source voltage and the panel current according to the different power source voltage levels, setting a reference point defined by a predetermined power source voltage and a panel current corresponding to the predetermined power source voltage and a plurality of first comparison points defined by a plurality of the power source voltages at different levels and the panel currents respectively corresponding thereto, calculating differential coefficients between the plurality of first comparison points and the reference point from the reference point in a descending order, calculating differential coefficients between the plurality of first comparison points and the reference point from the reference point in an ascending order, comparing the differential coefficients calculated in the descending order with the corresponding differential coefficients calculated in the ascending order, determining a point between two of the first comparison points for which a differential coefficient calculated in the descending order becomes smaller than a differential coefficient calculated in the ascending order to be a saturation point, and determining a power source voltage corresponding to the saturation point to be the saturation point.

The reference point may be set by a panel current and a power source voltage that are larger than those of the plurality of first comparison points.

Determining the saturation point may include setting the two first comparison points of which the differential coefficient calculated in the descending order becomes smaller than the differential coefficient calculated in the ascending order to a start point and a last point, respectively, setting a plurality of second comparison points defined by a plurality of the power source voltages at different levels and the panel currents respectively corresponding thereto between the start and last points, calculating differential coefficients between the plurality of second comparison points and the reference point from the reference point in a descending order, calculating differential coefficients between the plurality of second comparison points and the reference point from the reference point in an ascending order, comparing the differential coefficients calculated in the descending order and the differential coefficients calculated in the ascending order, when the differential coefficients calculated in the descending order become smaller than the differential coefficients calculated in the ascending order, determining a point between the corresponding two second comparison points to be a saturation point, and detecting a power source voltage corresponding to the saturation point as the saturation voltage.

The point between the corresponding two second comparison points may be a middle point between the corresponding two second comparison points.

The point between point between two of the first comparison points may be a middle point between the corresponding two first comparison points.

Controlling the feedback voltage may include varying the power source voltage to be different levels, storing the power source voltage and the panel current according to the different power source voltage levels, setting a reference point defined by a predetermined power source voltage and a panel current corresponding to the predetermined power source voltage and a plurality of comparison points defined by the plurality of the power source voltages at different levels and the panel currents respectively corresponding thereto, calculating a difference between differential coefficients of two adjacent comparison points and the reference point in an order from a closest comparison point to the reference point to a farthest comparison point to the reference point among the plurality of comparison points, comparing the difference of the two differential coefficients with a predetermined threshold value, when the difference of the two differential coefficients is smaller than the threshold value, determining a point between the corresponding two comparison points to be a saturation point, and determining a power source voltage corresponding to the saturation point as the saturation voltage.

The point between the corresponding two comparison points may be a middle point between the corresponding two comparison points.

Controlling the feedback voltage may include varying the power source voltage to be different levels, storing the power source voltage and the panel current according to the different power source voltage levels, setting a plurality of comparison points defined by a plurality of the power source voltages at different levels and the panel currents respectively corresponding thereto, sequentially calculating a differential coefficient between two adjacent comparison points in an order from a comparison point corresponding to a highest panel current to a comparison point corresponding to a lowest panel current, comparing a difference between a first of the differential coefficients and a second of the differential coefficients calculated in sequence corresponding to adjacent ones of the comparison points with a predetermined threshold value, when the difference of the first and second differential coefficients is smaller than the threshold value, determining an average point of the comparison points corresponding to the first and second differential coefficients to be the saturation point, and determining a power source voltage corresponding to the saturation point as the saturation voltage.

A first of the differential coefficients may relate to a first comparison point and a second comparison point, and the second of the differential coefficients relates to third comparison point and a fourth comparison point, the first, second, third and fourth comparison points being adjacent to each other in sequence.

A first of the differential coefficients may relate to a first comparison point and a second comparison point, and the second of the differential coefficients relates to the second comparison point and a third comparison point, the first, second, and third comparison points being adjacent to each other in sequence.

Controlling the feedback voltage may include varying the power source voltage to be different levels, storing the power source voltage and the panel current according to the different power source voltage levels, setting a plurality of comparison points defined by a plurality of the power source voltages at different levels and the panel currents respectively corresponding thereto, sequentially calculating a difference between differential coefficients of two adjacent comparison points in an order from a comparison point corresponding to a lowest panel current to a comparison point corresponding to a highest panel current, comparing a difference of a first of the differential coefficients and a second of the differential coefficients calculated in sequence with corresponding to sequential ones of the comparison points, when the first differential coefficient is larger than the second differential coefficient, determining a point between the comparison points corresponding to the two differential coefficients to be the saturation point, and determining a power source voltage corresponding to the saturation point as the saturation voltage.

The point between the comparison points corresponding to the two differential coefficients may be a middle point between the comparison points.

Controlling the feedback voltage may include varying the power source voltage to be different levels, storing the power source voltage and the panel current according to the different power source voltage levels, setting a plurality of comparison points defined by a plurality of the power source voltages at different levels and the panel currents respectively corresponding thereto, sequentially calculating differential coefficients, each of the differential coefficients being based on at least one of the comparison points, determining whether a relationship of at least two corresponding ones of the calculated differential coefficients meets a predetermined condition, when the predetermined condition is met, determining a point between the respective comparison points on which the two corresponding ones of the calculated differential coefficients that met the predetermined condition were based to be the saturation point, and determining a power source voltage corresponding to the saturation point as the saturation voltage.

Sequentially calculating differential coefficients may include sequentially calculating differential coefficients between a predetermined reference point and one of the comparison points.

Sequentially calculating differential coefficients may include sequentially calculating differential coefficients between a two of the comparison points.

Determining whether a relationship of at least two corresponding ones of the calculated differential coefficients meets a predetermined condition, may include comparing a difference between two corresponding ones of the calculated differential coefficients with a predetermined threshold value.

Determining whether a relationship of at least two corresponding ones of the calculated differential coefficients meets a predetermined condition may include comparing one of the corresponding ones of the calculated differential coefficients with the other of the corresponding ones of the calculated differential coefficients to determine which is larger.

At least one of the above and other features and advantages may be separately realized by providing a display device, including a display panel including a plurality of light emitting elements, the display panel being supplied with a predetermined power source voltage, a power source voltage controller adapted to determine the power source voltage and a panel current flowing to the display panel and to control a feedback voltage, and a direct current-direct current converter adapted to generate the power source voltage according to the feedback voltage, wherein the display device includes a saturation region and a non-saturation region according to variation of the panel current that depends on variation of the power source voltage, and the power source voltage controller is adapted to control the feedback voltage to drive the power source voltage to be equal to a saturation voltage corresponding to a saturation point at a boundary between the saturation region and the non-saturation region.

The power source voltage controller may include a sensing resistor adapted to sense the panel current, an amplifier adapted to output an amplified voltage by amplifying a voltage difference at both terminals of the sensing resistor, an analog-digital converter adapted to output panel current data according to the amplified voltage, and a feedback controller adapted to control the power source voltage to be equal to the saturation voltage based on the determined power source voltage and the determined panel current data, and a feedback voltage generator adapted to generate the feedback voltage according to an output of the feedback controller.

BRIEF DESCRIPTION OF THE DRAWINGS

The above and other features and advantages will become more apparent to those of ordinary skill in the art by describing in detail exemplary embodiments with reference to the attached drawings, in which:

FIG. 6 illustrates a computational sequence for a first exemplary method for determining a saturation point according to the exemplary driving method of FIG. 5;

FIG. 9 illustrates a computational sequence for an exemplary method for determining a saturation point according to the exemplary driving method of FIG. 8;

FIG. 11 illustrates a computational sequence for an exemplary method for determining a saturation point according to the exemplary driving method of FIG. 10;

FIG. 13 illustrates a computational sequence for an exemplary method for determining a saturation point according to the exemplary driving method of FIG. 12.

DETAILED DESCRIPTION

Figure 1:
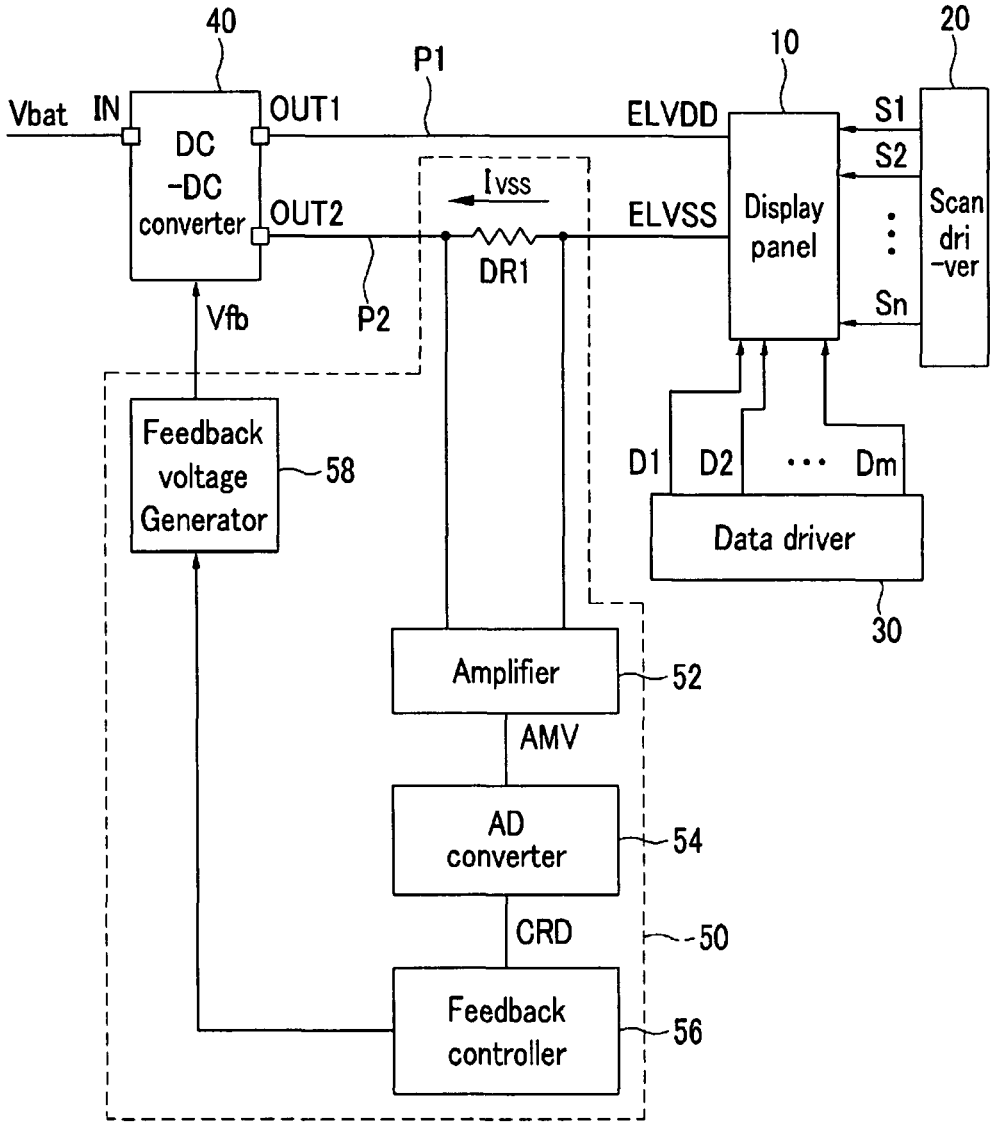
FIG. 1 illustrates schematic diagram of an exemplary embodiment of a display device.

Korean Patent Application No. 10-2009-0083127, filed on Sep. 3, 2009, in the Korean Intellectual Property Office, and entitled: "Display Device and Driving Method Thereof," is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

Throughout this specification and the claims that follow, when it is described that an element is "coupled" to another element, the element may be "directly coupled" to the other element or "electrically coupled" to the other element through a third element. It will also be understood that when an element is referred to as being "between" two elements, the element may be the only element between the two elements, or one or more intervening elements may also be present. In addition, unless explicitly described to the contrary, the word "comprise" and variations such as "comprises" or "comprising" will be understood to imply the inclusion of stated elements but not the exclusion of any other elements. Like reference numerals refer to like elements throughout the specification.

Figure 2:
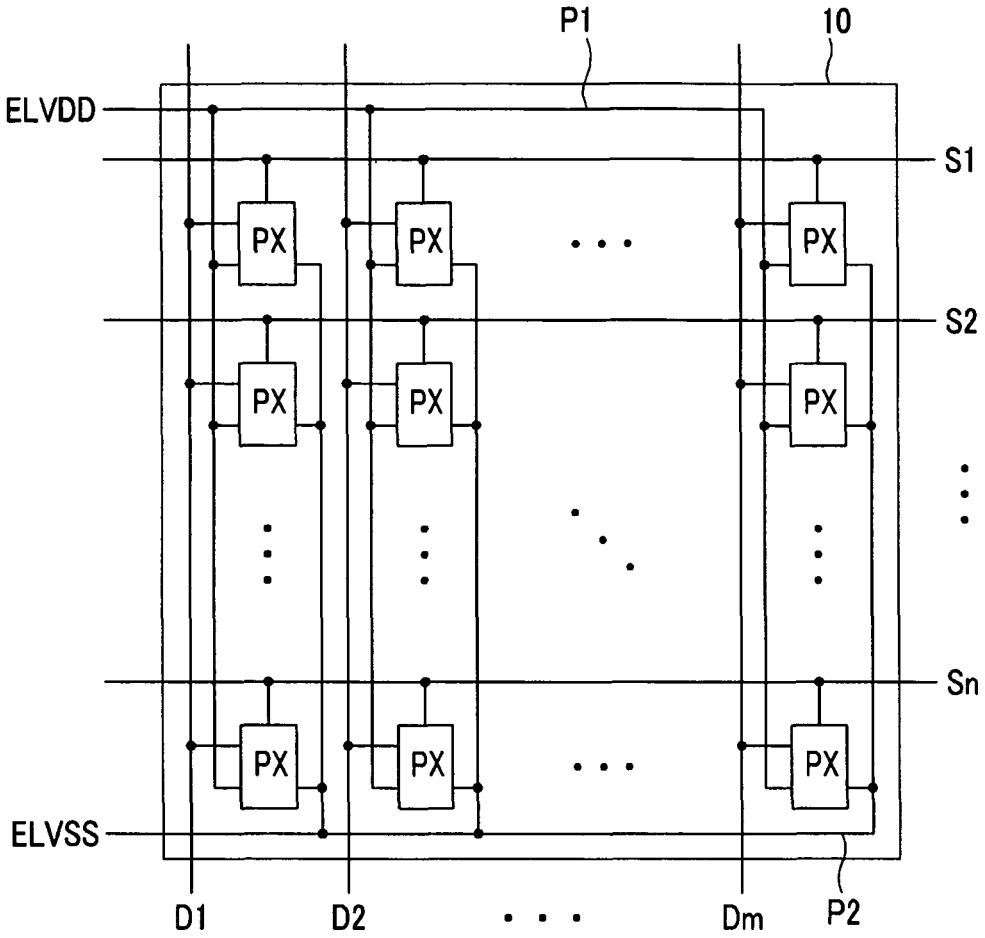
FIG. 2 illustrates a block diagram of an exemplary embodiment of a display panel of the display device of FIG. 1.
Figure 3:
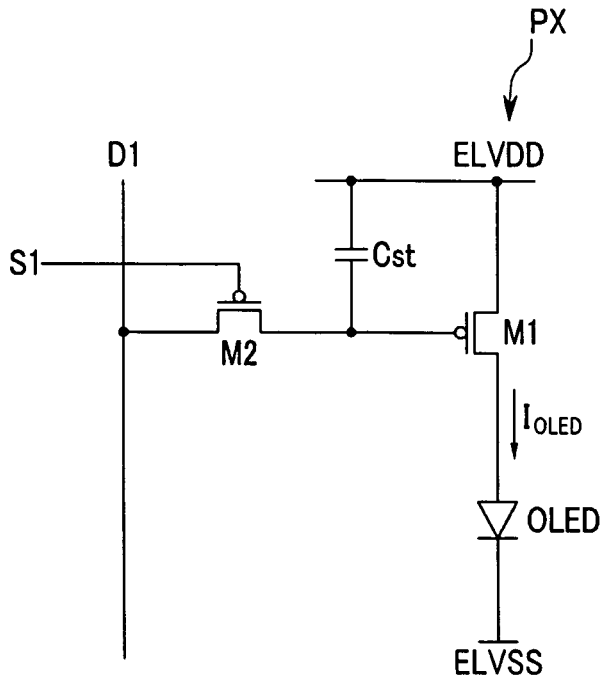
FIG. 3 illustrates a circuit diagram of an exemplary embodiment of a pixel employable by the display panel of FIG. 2.

FIG. 1 illustrates schematic diagram of an exemplary embodiment of a display device. FIG. 2 illustrates a block diagram of an exemplary embodiment of a display panel 10 of the display device of FIG. 1. FIG. 3 illustrates a circuit diagram of an exemplary embodiment of a pixel PX employable by the display panel 10 of FIG. 2.

Referring to FIG. 1, the display device may include a display panel 10, a scan driver 20, a data driver 30, a DC-DC converter 40, and a power source voltage controller 50. The display panel 10 may receive a first power source voltage ELVDD and a second power source voltage ELVSS from the DC-DC converter 40. The display panel 10 may receive a plurality of scan signals and a plurality of data signals from the scan driver 20 and the data driver 30, respectively. The display panel 10 may display images using the received scan and data signals.

Referring to FIG. 2, the display panel 10 may include a plurality of signal lines S1 to Sn, D1 to Dm, and a plurality of pixels PX connected to first and second power source lines P1 and P2 and arranged, e.g., approximately in a matrix format. The plurality of signal lines S1 to Sn and D1 to Dm may include a plurality of scan lines S1 to Sn to which the plurality of scan signals may be sequentially transmitted and a plurality of data lines D1 to Dm to which the plurality of data signals may be sequentially transmitted.

The plurality of scan lines S1 to Sn may substantially extend along a row direction. The plurality of data lines D1 to Dm may substantially extend along a column direction. The plurality of scan lines S1 to Sn may be substantially parallel to each other. The plurality of data lines D1 to Dm may be substantially parallel to each other. The first power line P1 may connect a first output terminal OUT1 of the DC-DC converter 40 and the display panel 10. The second power line P2 may connect a second output terminal OUT2 and the display panel 10.

Referring to FIGS. 1 and 2, the first power line P1 may extend to each of the plurality of pixels PX to supply a first power source voltage ELVDD output through a first output terminal OUT1 of the DC-DC converter 40 to the respective pixels PX. The second power line P2 may extend to each of the plurality of pixels PX and may supply a second power source voltage ELVSS output through a second output terminal OUT2 of the DC-DC converter 40 to the respective pixels PX. More particularly, the second power line P2 may be connected to a cathode of each of the plurality of pixels PX so that a panel current Ivss may flow to the second power line P2. More particularly, a sum of a current flowing to each of the plurality of pixels PX of the display panel 10 may flow to the second power line P2.

Referring to FIG. 3, each of the pixels PX, e.g., a pixel PX connected to the scan line S1 and the data line D1, may include an organic light emitting diode OLED, a driving transistor M1, a capacitor Cst, and a switching transistor M2.

The driving transistor M1 may receive the first power source voltage ELVDD through a source terminal. A drain terminal of the first transistor M1 may be connected to an anode of the organic light emitting diode OLED. A gate terminal of the driving transistor M1 may be connected to a drain terminal of the switching transistor M2. The driving transistor M1 may flow a current $I_{OLED}$ that varies according to a voltage applied between the gate and the drain terminals thereof. A gate terminal of the switching transistor M2 may be connected to the scan line S1, and a source terminal of the switching transistor M2 may be connected to the data line D1. The switching transistor M2 may perform a switching operation in response to a scan signal applied to the scan line S1, and a data signal applied to the data signal 151. A data voltage may be transmitted to the gate terminal of the driving transistor M1 when the switching transistor M2 is turned on.

The capacitor Cst may be connected between the source and gate terminals of the driving transistor M1. The capacitor Cst may charge the data voltage applied to the gate terminal of the driving transistor M1 and may continue the charging of the data voltage after the switching transistor M2 is turned on.

The organic light emitting diode OLED may receive the second power source voltage ELVSS through a cathode thereof. The organic light emitting diode OLED may emit light with different intensities according to the current IOLED supplied from the driving transistor M1. In FIG. 3, the driving transistor M1 and the switching transistor M2 are p-channel field effect transistors (FET), but embodiments are not limited thereto. For example, at least one of the driving transistor M1 and the switching transistor M2 may be an n-channel FET. Further, embodiments are not limited to the connection scheme of the driving and switching transistors M1 and M2, the capacitor Cst, and the organic light emitting diode OLED, as illustrated in FIG. 3, i.e., a different connection scheme may be employed. The pixel PX of FIG. 3 is an example of a pixel of the display device. Embodiments are not limited thereto, e.g., other pixel structures including at least two transistors and/or at least one capacitor may be used.

Referring back to FIG. 1, the scan driver 20 may be connected to the plurality of scan lines S1 to Sn of the display panel 10. The scan driver 20 may sequentially apply a scan signal to the plurality of scan lines S1 to Sn. The data driver 30 may be coupled to the data line D1 to Dm of the display panel 10. The data driver 30 may generate a plurality of data signals and may apply the data signals to the plurality of data lines D1 to Dm. The DC-DC converter 40 may receive an input voltage Vbat through an input terminal IN and may generate the first and second power source voltages ELVDD and ELVSS. The DC-DC converter 40 may control the second power source voltage ELVSS according to a feedback voltage Vfb.

The power source voltage controller 50 may include a sensing resistor DR1, an amplifier 52, an analog-digital (AD) converter 54, a feedback controller 56, and a feedback voltage generator 58.

The sensing resistor DR1 may be disposed on the second power line P2. A panel current Ivss flowing through the second power source line P2 may flow through the sensing resistor DR1. Accordingly, a voltage difference may exist across terminals of the sensing resistor DR1. The power source voltage controller 50 may sense the panel current Ivss based on the voltage across the terminals of the sensing resistor DR1. Hereinafter, the voltage difference across the terminals of the sensing resistor DR1 is referred to as a sensing voltage VS.

The amplifier 52 may amplify the sensing voltage VS, and may transmit the amplified sensing voltage VS (hereinafter, referred to as an amplified voltage AMV) to the AD converter 54. The AD converter 54 may output data CRD with respect to the panel current Ivss according to the amplified voltage AMV. Hereinafter, the data CRD is referred to as panel current data.

The feedback controller 56 may control the feedback voltage Vfb according to the panel current data CRD that depends on the second power source voltage ELVSS. The feedback controller 56 may control the second power source voltage ELVSS for operation of driving transistors M1 of all the pixels PX of the display panel 10 in a saturation region. Based on a relationship between the second power source voltage ELVSS and the panel current Ivss, a saturation region and a non-saturation region may be defined according to variation of the panel current Ivss that depends on variation of the second power source voltage ELVSS when the second power source voltage ELVSS is higher than a predetermined voltage.

Figure 4:
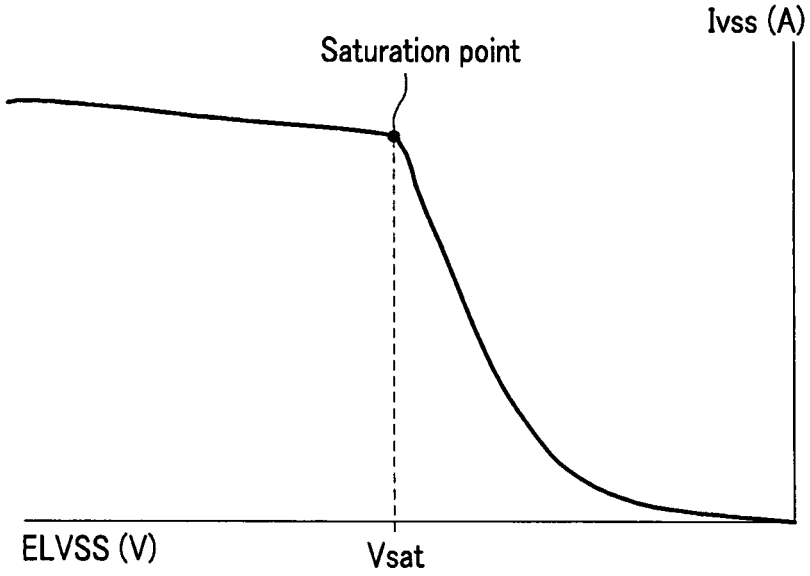
FIG. 4 illustrates a graph representing characteristics between a second power source voltage and a panel current.

FIG. 4 illustrates a graph representing characteristics between the second power source voltage ELVSS and a panel current Ivss. As shown in FIG. 4, the saturation region has a slope that is less steep than that of the non-saturation region. The relationship between the second power source voltage ELVSS and the panel current Ivss may be checked by detecting variation of the panel current Ivss in accordance with variation of the second power source voltage ELVSS without variation of the data signal supplied to the display panel 10.

More particularly, in FIG. 4, a region where the second power source voltage ELVSS is less than a saturation voltage Vsat is the saturation region. In the curve of FIG. 4, a point corresponding to the saturation voltage Vsat is referred to as a saturation point.

The feedback controller 50 may track variation of the panel current Ivss relative to variation in the second power source voltage ELVSS to find the saturation point shown in FIG. 4 for a period during which a data signal for displaying a full-white image is applied to the display panel 10. The feedback controller 50 may control the feedback voltage Vfc to change the second power source voltage ELVSS at the saturation point as a current power source voltage. When the second power source voltage ELVSS is smaller than the voltage Vsat, a voltage difference between the second power source voltage ELVSS and the first power source voltage ELVDD may be increased so that a voltage difference across terminals of the driving transistor M1 and the organic light emitting diode OLED may be increased, and, as a result, power consumption may also be increased.

Furthermore, as the OLED display deteriorates over time, the relationship curve shown in FIG. 4 may change and, more particularly, the saturation point may change. The feedback controller 56 may sense the relationship between the second power source voltage ELVSS and the panel current Ivss, and may control the feedback voltage Vfb to set the second power source voltage ELVSS at the saturation voltage Vsat. A detailed operation of the feedback controller 56 will be described with reference to FIG. 5 to FIG. 13. The feedback voltage generator 58 may generate the feedback voltage Vfb according to an output of the feedback controller 56 and may supply the generated feedback voltage Vfb to the DC-DC converter 40.

Figure 5:
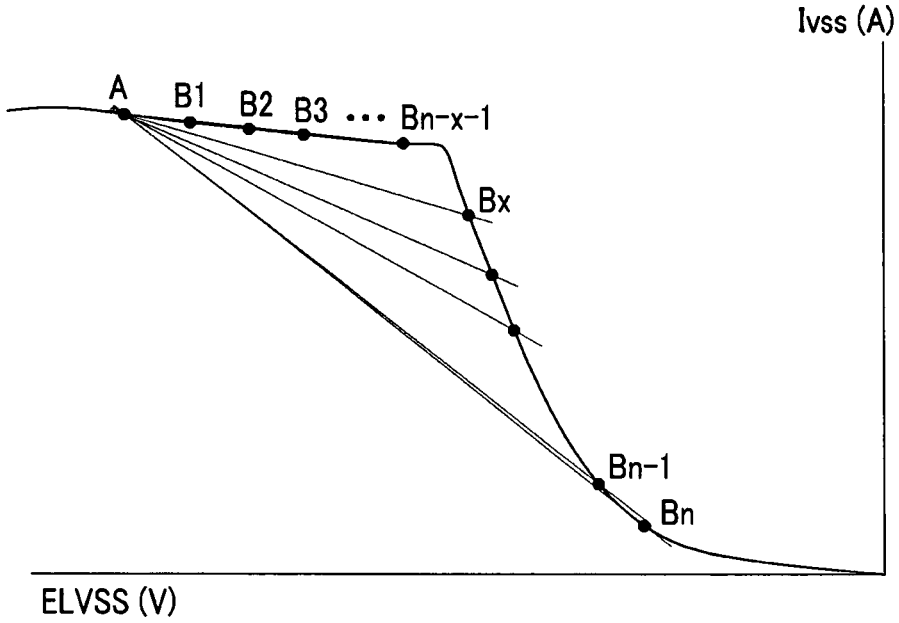
FIG. 5 illustrates a graph of a relationship between a power source voltage and panel current for describing an exemplary embodiment of a driving method for driving a display device.

FIG. 5 illustrates a graph of a relationship between a power source voltage and panel current for describing an exemplary embodiment of a driving method for driving a display device. FIG. 6 illustrates a computational sequence for a first exemplary method for determining a saturation point according to the exemplary driving method of FIG. 5.

Referring to FIGS. 1 and 5, in such embodiments, the feedback controller 56 may change a second power source voltage ELVSS to different levels during a test period. The test period may be set to a constant period or may be generated according to a user's command. The feedback controller 56 may store the second power source voltage ELVSS and panel current data CRD according to the second power source voltage ELVSS.

More particularly, referring to FIG. 5, in such embodiments, the feedback controller 56 may set a predetermined reference point A and a plurality of comparison points B1, B2, B3, . . . , Bn-1, and Bn shown in FIG. 5. The feedback controller 56 may extract a second power source voltage ELVSS and panel current data CRD corresponding thereto for each of the comparison points B1, B2, B3, . . . , Bn-1, and Bn. The feedback controller 56 may sequentially calculate a differential coefficient Δ between the reference point A and the plurality of comparison points B1, B2, B3, . . . , Bn-1, and Bn. More particularly, the feedback controller 56 may sequentially calculate differential coefficients Δ between the reference point A and the plurality of comparison points B1, B2, B3, . . . , Bn-1, and Bn in a descending order, i.e., from the furthest comparison point to the closest comparison point, and in an ascending order, i.e., from the closest comparison point to the furthest comparison point. More particularly, the feedback controller 56 may sequentially compare corresponding pairs, e.g., B1 and Bn, B2 and Bn-1, B3 and Bn-2, etc., of differential coefficients between the reference point A and corresponding comparison points B until it is determined that the differential coefficient between the reference point A and the corresponding ascending order comparison point, e.g., Bx, is greater than the differential coefficient between the reference point A and the corresponding descending order comparison point, e.g., Bn-x−1. In the exemplary embodiment of FIG. 5, a reference point A corresponds to a largest panel current data CRD.

More particularly, referring to FIGS. 5 and 6, the feedback controller 56 may first compare a differential coefficient (Δ(A−B1)) between the reference point A and the first ascending comparison point B1 and a differential coefficient (Δ(A−Bn)) between the reference point A and the first descending comparison point Bn. If the differential coefficient (Δ(A−Bn)) is larger than the differential coefficient (Δ(A−B1)), the feedback controller 56 may compare a differential coefficient (Δ(A−B2)) between the next corresponding pair of ascending and descending comparison points, e.g., next ascending comparison point B2 and next descending comparison point Bn-1. If the differential coefficient (Δ(A−Bn-1)) is larger than the differential coefficient (Δ(A−B2)), differential coefficients Δ between each of the next two corresponding pair of ascending and descending comparison points, e.g., B3 and Bn-2, and the reference point A may be compared.

Such a comparison process may continue until a corresponding pair of ascending and descending comparison points are found for which a differential coefficient (Δ(A−Bn-x−1)) between the reference point A and the ascending comparison point Bx is smaller than the differential coefficient (Δ(A−Bx)) between the reference point A and the corresponding descending comparison point Bx−1. When the differential coefficient (Δ(A−Bn-x−1)) is smaller than the differential coefficient (Δ(A−Bx)), the feedback controller 56 may determine that a point, e.g., a center point, between the comparison point Bx and the comparison (Bn-x−1) is the saturation point. As a result, the feedback controller 56 may control the feedback voltage Vfb to supply, e.g., a middle value of the second power source voltage ELVSS corresponding to each of the comparison points Bx and (Bn-x−1) to the display panel 10. Accordingly, a margin of the second power source voltage ELVSS supplied to the display panel 10 may be minimized. By reducing and/or minimizing a margin of the second power source ELVSS, power consumption may be reduced and/or minimized.

Figure 7:
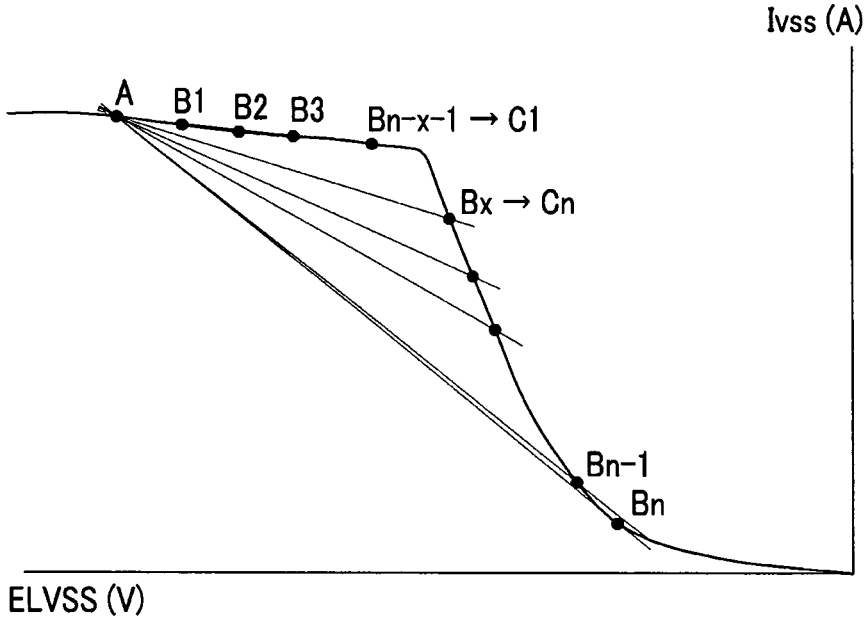
FIG. 7 illustrates a graph of a relationship between a power source voltage and panel current for describing a second exemplary embodiment of a driving method for driving a display device.

FIG. 7 illustrates a graph of a relationship between a power source voltage and panel current for describing a second exemplary embodiment of a driving method for driving a display device. In general, only differences between the exemplary method of FIG. 7 and the exemplary method of FIG. 5 will be described below. Like the exemplary method of FIGS. 5 and 6, the comparison process described above with regard to differential coefficients of corresponding pairs of ascending and descending comparison points may be carried out until a corresponding pair of ascending and descending comparison points are found for which a differential coefficient (Δ(A−Bn-x−1)) between the reference point A and the ascending comparison point Bx is smaller than the differential coefficient (Δ(A−Bx)) between the reference point A and the corresponding descending comparison point Bx−1

In the exemplary embodiment of FIG. 7, after, e.g., the ascending Bx comparison point and the descending Bn-x−1 comparison point satisfying the Δ(A−Bn-x−1)>Δ(A−Bx) are determined, the feedback controller 56 may set a plurality of sub-comparison points C1 to Cn based on the two determined ascending and descending comparison points Bx and Bn-x−1, respectively, and may calculate and compare differential coefficients between the reference point A and each of sub-comparison points of a corresponding pair among the plurality sub-comparison points. More particularly, e.g., the feedback controller 56 may set the comparison point Bx as a first sub-comparison point C1, and may set the comparison point (Bn-x−1) as a last sub-comparison point Cn. That is, in the exemplary embodiment of FIG. 7, the feedback controller 56 may find a saturation point by setting and using a plurality of sub-comparison points C1 to Cn. The comparison process described above with regard to comparison points B1 to Bn in FIG. 5 may then be carried out with regard to sub-comparison points C1 to Cn. By setting the sub-comparison points, the saturation point may be more accurately determined as compared to determining the saturation point based on the initial comparison points B1 to Bn alone.

Figure 8:
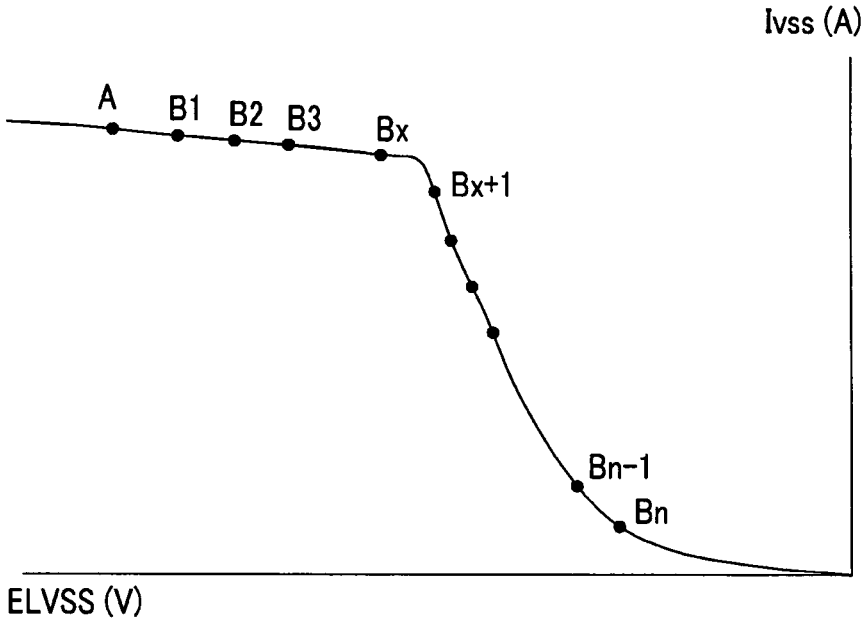
FIG. 8 illustrates a graph of a relationship between a power source voltage and panel current for describing a third exemplary embodiment of a driving method for driving a display device.

FIG. 8 illustrates a graph of a relationship between a power source voltage and panel current for describing a third exemplary embodiment of a driving method for driving a display device. FIG. 9 illustrates a computational sequence for an exemplary method for determining a saturation point according to the exemplary driving method of FIG. 8. In general, only differences between the exemplary embodiment of FIG. 8 and the exemplary embodiment of FIG. 5 will be described below.

Referring to FIG. 8, in such embodiments, the feedback controller 56 may set a predetermined reference point A and a plurality of comparison points B1, B2, B3, . . . , Bn-1, and Bn. The feedback controller 56 may generate a differential coefficient between the reference point A and a first comparison point among the plurality of comparison points B1, B2, B3, . . . , Bn-1, and Bn, may generate a differential coefficient between the reference point A and a second comparison point among the plurality of comparison points B1, B2, B3, . . . , Bn-1, and Bn, and may compare a difference of the two generated differential coefficients with a predetermined threshold value α. The comparison points B1 to Bn may be sequentially set in ascending order from the closest comparison point B1 to the reference point A to the farthermost comparison point Bn to the reference point A. In such embodiments, the first comparison points may be sequentially selected in ascending order, and the sequentially adjacent one in ascending order may be selected as the corresponding second comparison point such that if B2 is selected as the first comparison point, B3 is selected as the corresponding second comparison point. In such cases, if a subsequent comparison is necessary, B3 may be selected as the first comparison point and B4 may be selected as the corresponding second comparison point.

Referring still to FIGS. 1 and 8, the feedback controller 56 may extract a second power source voltage ELVSS and panel current data CRD corresponding to a first comparison point that is closer to the reference point A than a second comparison point of a corresponding pair of first and second comparison points. More particularly, the first comparison point and the second comparison point of a corresponding pair of first and second comparison points may be immediately adjacent to each other in ascending order, and the first comparison point may be closer to the reference point A. The feedback controller 56 may subtract a differential coefficient between the reference point A and the second comparison point from a differential coefficient between the reference point A and the first comparison point, and may compare the subtraction result with the threshold value α.

When the difference between the two differential coefficients is equal to or greater than the threshold value α, the two comparison points may be determined to be irrelevant with regard to the saturation point. As a result, the feedback controller 56 may continues the above-described process in a direction away from the reference point A, e.g., next corresponding first and second comparison points in ascending order. Thus, e.g., if B2 and B3 were the first and second comparison points, respectively, and the resulting difference between the two differential coefficients was equal to or greater than the corresponding threshold value α, the comparison process may be repeated with comparison points B3 and B4.

On the other hand, when the difference of the differential coefficients is smaller than the threshold value α, the feedback controller 56 may determine that the saturation point is located between, e.g., at the center of, the corresponding two comparison points. That is, in the exemplary embodiment of FIG. 8, only a second power source voltage ELVSS and panel current data CRD corresponding to two comparison points, e.g., B2 and B3, that are compared with the reference point A are extracted in real time to perform operation and comparison. Accordingly, embodiments may enable a memory size to be reduced and/or a time for determining the saturation point to be decreased.

More particularly, referring to FIG. 9, when employing the exemplary method of FIG. 8, to determine the saturation point, the feedback controller 56 may extract the reference point A, e.g., a largest panel current data CRD, and a second power source voltage ELVSS and panel current data CRD corresponding to comparison points, e.g., B1 and B2. In such embodiments, the feedback controller 56 may determine a difference ((Δ(A−B1))−(Δ(A−B2))) between a differential coefficient (Δ(A−B1)) of the reference point A and the comparison point B1 and a differential coefficient (Δ(A−B2)) of the reference point A and the comparison point B2. The feedback controller 56 may compare the difference between the corresponding differential coefficients ((Δ(A−B1))−(Δ(A−B2))) with the threshold value α.

When the difference of the differential coefficients is greater than the threshold value α, the feedback controller 56 may extract a second power source voltage ELVSS and panel current data CRD corresponding to subsequent comparison points, e.g., B2 and B3. The feedback controller 56 may determine a difference ((Δ(A−B2))−(Δ(A−B3))) between a differential coefficient (Δ(A−B2)) of the reference point A and the comparison point B2 and a differential coefficient (Δ(A−B3)) of the reference point A and the comparison point B3. The feedback controller 56 may compare the difference ((Δ(A−B2))−(Δ(A−B3))) between the differential coefficients with the threshold value α. During this process, when, e.g., a difference between a differential coefficient (Δ(A−Bx)) and a differential coefficient (Δ(A−Bx+1)) is determined to be smaller than the threshold value α, the feedback controller 56 may determine that the saturation point is located between, e.g., at the center of, the comparison points Bx and Bx+1. Then, the feedback controller 56 may control a feedback voltage Vfb to supply a value, e.g., a middle value, of a second power source voltage ELVSS of each of the comparison points Bx and Bx+1 to the display panel 10.

Figure 10:
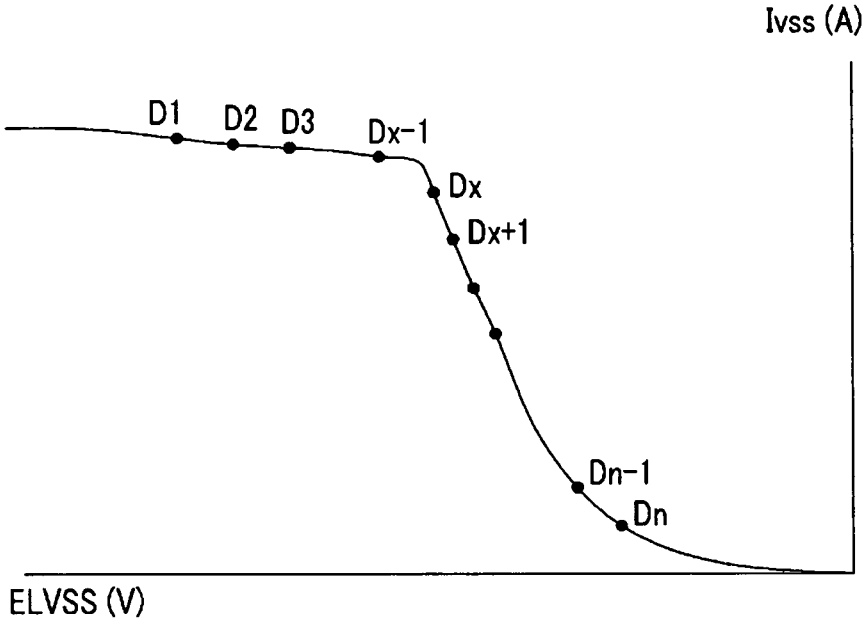
FIG. 10 illustrates a graph of a relationship between a power source voltage and panel current for describing a fourth exemplary embodiment of a driving method for driving a display device.

FIG. 10 illustrates a graph of a relationship between a power source voltage and panel current for describing a fourth exemplary embodiment of a driving method for driving a display device. FIG. 11 illustrates a computational sequence for an exemplary method for determining a saturation point according to the exemplary driving method of FIG. 10. In general, only differences between the exemplary embodiment of FIG. 10 and the exemplary embodiment of FIG. 8 will be described below.

Referring to FIGS. 1 and 10, the feedback controller 56 may set a plurality of comparison points D1, D2, D3, . . . , Dn-1, and Dn. In FIG. 10, the comparison point D1 among the plurality of comparison points D1, D2, D3, . . . , Dn-1, and Dn may be a comparison point corresponding to a highest panel current data CRD and the comparison point Dn may be a comparison point corresponding to a lowest panel current data CRD. That is, in the exemplary embodiment of FIG. 10, the first comparison point D1 corresponds to the highest panel current data CRD, whereas in the exemplary embodiment of FIG. 8, the reference point A corresponds to the highest panel current CRD. Further, in the exemplary embodiment of FIG. 10, the reference point A is not employed. More particularly, the exemplary method of FIG. 10 substantially corresponds to the exemplary method of FIG. 8, except that in the exemplary method of FIG. 10, each of the differential coefficients are determined between two comparison points rather than between the reference point A and the respective comparison point.

More particularly, referring to FIGS. 1 and 10, in such embodiments, the feedback controller 56 may calculate differential coefficients for two pairs of adjacent comparison points, e.g., Δ(D1−D2) and Δ(D2−D3), corresponding to three adjacent ones of the comparison points, e.g., D1, D2, D3, in an order from a comparison point D1 corresponding to the highest panel current data CRD to a comparison point Dn corresponding to the lowest panel current data CRD in real-time. The feedback controller 56 may then compare a difference (Δ(D1−D2)−Δ(D2−D3)) between the calculated differential coefficients with a predetermined threshold value α. When the difference between the two differential coefficients is smaller than the threshold value α, the feedback controller 56 may determine that the comparison point, e.g., D2, between the three adjacent ones of the comparison points, D1, D2, and D3, corresponding to the two calculated differential coefficients, may be a saturation point.

More particularly, referring to FIG. 11, in such embodiments, the feedback controller 56 may extract a second power source voltage ELVSS and panel current data CRD corresponding to three adjacent comparison points D1, D2, and D3. The feedback controller 56 may calculate a differential coefficient (Δ(D2−D1)) between the comparison points D1 and D2 and a differential coefficient (Δ(D2−D3)) between the comparison points D2 and D3, and may compare a difference between the two calculated differential coefficients (Δ(D2−D1)−Δ(D2−D3)) and the threshold value α. When the difference between the two differential coefficients (Δ(D2−D1)−Δ(D2−D3)) is larger than the threshold value α, the feedback controller 56 may extract a second power source value ELVSS and panel current data CRD corresponding to the next three adjacent comparison points D3, D4, and D5. The feedback controller 56 may then calculate a differential coefficient (Δ(D3−D4)) between the comparison points D3 and D4 and a differential coefficient (Δ(D4−D5)) between the comparison points D4 and D5, and may compare a difference of the two differential coefficients (Δ(D3−D4)−Δ(D4−D5)) and the threshold value α.

When the difference between the two differential coefficients (Δ(D3−D4)−Δ(D4−D5)) is larger than the threshold value α, the above-described process is performed on the next three adjacent comparison points, e.g., D5, D6, and D7. Such a process may be sequentially repeated until, e.g., a difference between a differential coefficient (Δ(Dx−1−Dx)) between comparison points (Dx−1) and Dx and a differential coefficient (Δ(Dx−Dx+1)) between comparison points Dx and (Dx+1) is determined to be smaller than the threshold value α. When such a determination is made, i.e., (Δ(Dx−1−Dx)−Δ(Dx−Dx+1))<α, the feedback controller 56 may determine that the comparison point Dx, e.g., the middle comparison point among the three comparison points (Dx−1), Dx, and (Dx+1), is the saturation point.

The feedback controller 56 may then control a feedback voltage Vfb to supply a second power source voltage ELVSS corresponding to the comparison point Dx to a display panel 10. In the exemplary embodiment illustrated in FIG. 11, e.g., some of the comparison points, e.g., D2, D4, D6, are commonly included in operation of the compared differential coefficients, however, embodiments, are not limited thereto. For example, the operation may be performed on comparison points D1 and D2 and comparison points D3 and D4, and the saturation point may correspond to an average of the comparison points D1, D2, D3, D4. In such cases, the saturation point may be found more quickly.

Figure 12:
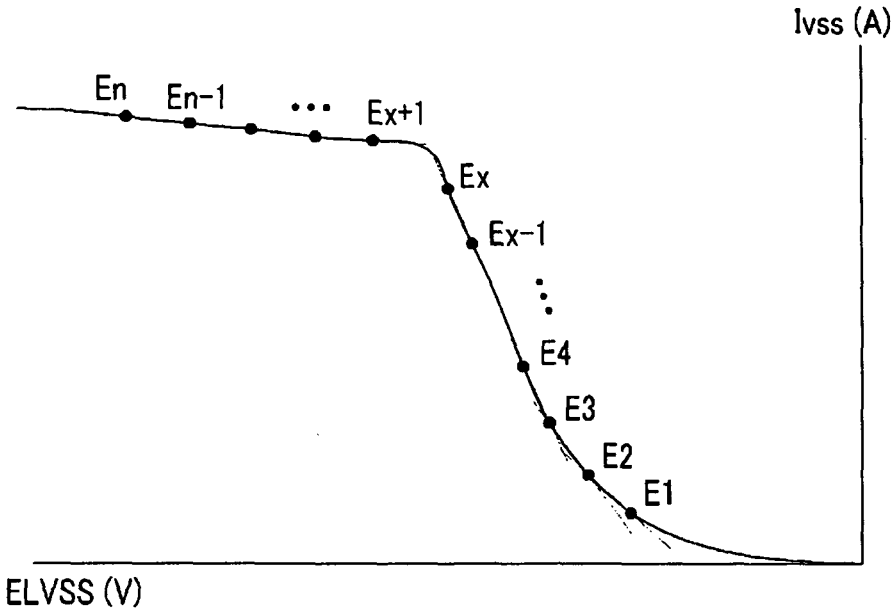
FIG. 12 illustrates a graph of a relationship between a power source voltage and panel current for describing a fifth exemplary embodiment of a driving method for driving a display device.

FIG. 12 illustrates a graph of a relationship between a power source voltage and panel current for describing a fifth exemplary embodiment of a driving method for driving a display device. FIG. 13 illustrates a computational sequence for an exemplary method for determining a saturation point according to the exemplary driving method of FIG. 12.

Referring to FIG. 12, in such embodiments, the feedback controller 56 may set a plurality of comparison points E1, E2, E3, . . . , En-1, and En. In FIG. 12, the comparison point E1 may be a comparison point corresponding to the lowest panel current data CRD and the comparison point En may be a comparison point corresponding to the highest panel current data CRD among the plurality of comparison points E1, E2, E3, . . . , En-1, and En.

In such embodiments, the feedback controller 56 may calculate differential coefficients between two pairs of adjacent comparison points, e.g., Δ(E2−E1) and Δ(E3−E2), corresponding to three adjacent ones of the comparison points, e.g., E1, E2, E3, in an order from a comparison point E1 corresponding to the lowest panel current data CRD to the comparison point En corresponding to the highest panel current data CRD in real time, and may compare the two calculated differential coefficients. When the differential coefficient, e.g., Δ(E2−E1), between the comparison points corresponding to the lower panel current data CRD is larger than the differential coefficient, e.g., Δ(E3−E2), between the comparison points corresponding to the higher panel current data CRD, the feedback controller 56 may determine that the comparison point, e.g., E2, between the three adjacent ones of the comparison points E1, E2, and E3, corresponding to the two calculated differential coefficients, may be a saturation point.

More particularly, referring to FIG. 13, in such embodiments, the feedback controller 56 may extract a second power source voltage ELVSS and panel current data CRD corresponding to three adjacent comparison points E1, E2, and E3. The feedback controller 56 may calculate a differential coefficient (Δ(E2−E1)) between the comparison points E1 and E2 and a differential coefficient (Δ(E3−E2)) between the comparison points E2 and E3, and may compare a difference between the two calculated differential coefficients (Δ(E2−E1)) and (Δ(E3−E2)). When the differential coefficients (Δ(E2−E1)) is smaller than the differential coefficient (Δ(E3−E2)), the feedback controller 56 may extract a second power source value ELVSS and panel current data CRD corresponding to the next comparison points E2, E3, and E4. The feedback controller 56 may calculate a differential coefficient (Δ(E3−E2)) between the comparison points E2 and E3 and a differential coefficient (Δ(E4−E3)) between the comparison points E3 and E4, and may compare the differential coefficient (Δ(E3−E2)) with the differential coefficient (Δ(E4−E3)).

When the differential coefficient (Δ(E3−E2)) is smaller than the differential coefficient (Δ(E4−E3)), the feedback controller 56 may perform the above-described process on the next comparison points, e.g., E3, E4, and E5. While sequentially performing such a process, when, e.g., a difference of a differential coefficient (Δ(Ex−Ex−1)) between comparison points (Ex−1) and Ex and is larger than a differential coefficient (Δ(Ex+1−Ex)) between comparison points (Ex+1) and Ex, the feedback controller 56 may determine, e.g., the middle point of the comparison points Ex and (Ex+1) to be a saturation point. Then, the feedback controller 56 may then control a feedback voltage Vfb to supply, e.g., the middle value of the second power source voltages ELVSS respectively corresponding to the comparison points Ex and (Ex+1) to a display panel 10.

As described above, embodiments may enable a saturation point to be detected using panel current data according to a second power source voltage ELVSS so that the second power source voltage ELVSS corresponding to a characteristic of a panel may be supplied without and/or a reduced margin, thereby preventing and/or reducing an unnecessary increase in power consumption.

Further, while the exemplary additional comparisons of the exemplary embodiment of FIG. 7 are only explicitly described with regard to the exemplary embodiment of FIG. 5, it should be understood that additional comparisons may be carried out for any embodiment.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A driving method for a display device including a display panel that is supplied with a power source voltage, and includes a plurality of light emitting elements, the display device including a saturation region and a non-saturation region according to variation of a panel current flowing to the display panel, the driving method comprising:

sensing the panel current;

determining the power source voltage and the panel current;

controlling a feedback voltage to drive the power source voltage to be equal to a saturation voltage corresponding to a saturation point at a boundary between the saturation region and the non-saturation region based on the determined power source voltage and the determined panel current, wherein controlling the feedback voltage includes:

varying the power source voltage to be different levels;

storing the power source voltage and the panel current according to the different power source voltage levels;

setting a reference point defined by a predetermined power source voltage and a panel current corresponding to the predetermined power source voltage and a plurality of first comparison points defined by a plurality of the power source voltages at different levels and the panel currents respectively corresponding thereto;

calculating differential coefficients between the plurality of first comparison points and the reference point from the reference point in a descending order;

calculating differential coefficients between the plurality of first comparison points and the reference point from the reference point in an ascending order;

comparing the differential coefficients calculated in the descending order with the corresponding differential coefficients calculated in the ascending order;

determining a point between two of the first comparison points for which a differential coefficient calculated in the descending order becomes smaller than a differential coefficient calculated in the ascending order to be a saturation point; and determining a power source voltage corresponding to the saturation point to be the saturation point; and controlling the power source voltage according to the feedback voltage to supply the controlled power source voltage to each of the plurality of light emitting elements.

2. The driving method as claimed in claim 1, wherein the reference point is set by a panel current and a power source voltage that are larger than those of the plurality of first comparison points.

3. The driving method as claimed in claim 1, wherein determining the saturation point comprises:

setting the two first comparison points of which the differential coefficient calculated in the descending order becomes smaller than the differential coefficient calculated in the ascending order to a start point and a last point, respectively;

setting a plurality of second comparison points defined by a plurality of the power source voltages at different levels and the panel currents respectively corresponding thereto between the start and last points;

calculating differential coefficients between the plurality of second comparison points and the reference point from the reference point in a descending order;

calculating differential coefficients between the plurality of second comparison points and the reference point from the reference point in an ascending order;

comparing the differential coefficients calculated in the descending order and the differential coefficients calculated in the ascending order;

when the differential coefficients calculated in the descending order become smaller than the differential coefficients calculated in the ascending order, determining a point between the corresponding two second comparison points to be a saturation point; and detecting a power source voltage corresponding to the saturation point as the saturation voltage.

4. The driving method as claimed in claim 3, wherein the point between the corresponding two second comparison points is a middle point between the corresponding two second comparison points.

5. The driving method as claimed in claim 1, wherein the point between point between two of the first comparison points is a middle point between the corresponding two first comparison points.

6. A driving method for a display device including a display panel that is supplied with a power source voltage, and includes a plurality of light emitting elements, the display device including a saturation region and a non-saturation region according to variation of a panel current flowing to the display panel, the driving method comprising:

sensing the panel current;

determining the power source voltage and the panel current;

controlling a feedback voltage to drive the power source voltage to be equal to a saturation voltage corresponding to a saturation point at a boundary between the saturation region and the non-saturation region based on the determined power source voltage and the determined panel current, wherein controlling the feedback voltage includes:

varying the power source voltage to be different levels;

storing the power source voltage and the panel current according to the different power source voltage levels;

setting a plurality of comparison points defined by a plurality of the power source voltages at different levels and the panel currents respectively corresponding thereto;

sequentially calculating differential coefficients, each of the differential coefficients being based on at least one of the comparison points;

determining whether a relationship of at least two corresponding ones of the calculated differential coefficients meets a predetermined condition;

when the predetermined condition is met, determining a point between the respective comparison points on which the two corresponding ones of the calculated differential coefficients that met the predetermined condition were based to be the saturation point; and determining a power source voltage corresponding to the saturation point as the saturation voltage; and controlling the power source voltage according to the feedback voltage to supply the controlled power source voltage to each of the plurality of light emitting elements.

7. The driving method as claimed in claim 6, wherein sequentially calculating differential coefficients includes sequentially calculating differential coefficients between a predetermined reference point and one of the comparison points.

8. The driving method as claimed in claim 6, wherein sequentially calculating differential coefficients includes sequentially calculating differential coefficients between a two of the comparison points.

9. The driving method as claimed in claim 6, wherein determining whether a relationship of at least two corresponding ones of the calculated differential coefficients meets a predetermined condition, includes comparing a difference between two corresponding ones of the calculated differential coefficients with a predetermined threshold value.

10. The driving method as claimed in claim 6, wherein determining whether a relationship of at least two corresponding ones of the calculated differential coefficients meets a predetermined condition, includes comparing one of the corresponding ones of the calculated differential coefficients with the other of the corresponding ones of the calculated differential coefficients to determine which is larger.

11. A display device, comprising:

a display panel including a plurality of light emitting elements, the display panel being supplied with a predetermined power source voltage;

a power source voltage controller adapted to determine the power source voltage and a panel current flowing to the display panel and to control a feedback voltage; and a direct current-direct current converter adapted to generate the power source voltage according to the feedback voltage, wherein the display device includes a saturation region and a non-saturation region according to variation of the panel current that depends on variation of the power source voltage, and the power source voltage controller is adapted to control the feedback voltage to drive the power source voltage to be equal to a saturation voltage corresponding to a saturation point at a boundary between the saturation region and the non-saturation region, the power source voltage controller being adapted to:

vary the power source voltage to be different levels;

store the power source voltage and the panel current according to the different power source voltage levels;

set a plurality of comparison points defined by a plurality of the power source voltages at different levels and the panel currents respectively corresponding thereto;

sequentially calculate differential coefficients, each of the differential coefficients being based on at least one of the comparison points;

determine whether a relationship of at least two corresponding ones of the calculated differential coefficients meets a predetermined condition;

when the predetermined condition is met, determine a point between the respective comparison points on which the two corresponding ones of the calculated differential coefficients that met the predetermined condition were based to be the saturation point; and determine a power source voltage corresponding to the saturation point as the saturation voltage.

12. The display device as claimed in claim 11, wherein the power source voltage controller comprises:

a sensing resistor adapted to sense the panel current;

an amplifier adapted to output an amplified voltage by amplifying a voltage difference at both terminals of the sensing resistor;

an analog-digital converter adapted to output panel current data according to the amplified voltage; and a feedback controller adapted to control the power source voltage to be equal to the saturation voltage based on the determined power source voltage and the determined panel current data; and a feedback voltage generator adapted to generate the feedback voltage according to an output of the feedback controller.

13. The display device as claimed in claim 11, wherein the power source voltage controller is adapted to sequentially calculate differential coefficients between a predetermined reference point and one of the comparison points.

14. The display device as claimed in claim 11, wherein the power source voltage controller is adapted to sequentially calculate differential coefficients between a two of the comparison points.

15. The display device as claimed in claim 11, wherein the power source voltage controller is adapted to compare a difference between two corresponding ones of the calculated differential coefficients with a predetermined threshold value.

16. The display device as claimed in claim 11, wherein the power source voltage controller is adapted to compare one of the corresponding ones of the calculated differential coefficients with the other of the corresponding ones of the calculated differential coefficients to determine which is larger.

* * * * *